US011604032B2

(12) United States Patent
Kester et al.

(10) Patent No.: US 11,604,032 B2
(45) Date of Patent: Mar. 14, 2023

(54) FINNED HEAT EXCHANGER U-BENDS, MANIFOLDS, AND DISTRIBUTOR TUBES

(71) Applicant: Johnson Controls Technology Company, Auburn Hills, MI (US)

(72) Inventors: Douglas A. Kester, York, PA (US); Nicholas P. Mislak, Bel Air, MD (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 382 days.

(21) Appl. No.: 16/730,302

(22) Filed: Dec. 30, 2019

(65) Prior Publication Data

US 2020/0132381 A1 Apr. 30, 2020

Related U.S. Application Data

(63) Continuation of application No. 15/614,396, filed on Jun. 5, 2017, now Pat. No. 10,520,255.

(60) Provisional application No. 62/421,047, filed on Nov. 11, 2016.

(51) Int. Cl.

| | |
|---|---|
| ***F28D 1/047*** | (2006.01) |
| ***F28D 1/04*** | (2006.01) |
| ***F28F 9/02*** | (2006.01) |
| ***F28F 1/12*** | (2006.01) |
| ***F28F 1/24*** | (2006.01) |
| *F28D 21/00* | (2006.01) |
| *F28F 1/10* | (2006.01) |

(52) U.S. Cl.

CPC ..... *F28D 1/0477* (2013.01); *F28D 1/0443* (2013.01); *F28F 1/124* (2013.01); *F28F 1/24* (2013.01); *F28F 9/0275* (2013.01); *F28D 2021/0068* (2013.01); *F28F 1/10* (2013.01); *F28F 2009/0292* (2013.01)

(58) Field of Classification Search

CPC .. F28F 9/0275; F28F 2009/0292; F28F 1/124; F28F 1/24; F28F 1/10; F28D 2021/0068; F28D 1/0477; F28D 1/0443

USPC ..... 165/175, 174

See application file for complete search history.

(56) References Cited

U.S. PATENT DOCUMENTS

| | | | | |
|---|---|---|---|---|
| 2,868,515 A * | 1/1959 | Garland | F28F 1/36 165/172 |
| 2,945,360 A | 7/1960 | Tyler | |
| 3,877,517 A | 4/1975 | Pasternak | |
| 4,546,820 A * | 10/1985 | Whipple | F28D 1/0435 165/77 |
| 4,794,985 A * | 1/1989 | Paulman | B21D 31/00 165/172 |

(Continued)

FOREIGN PATENT DOCUMENTS

| | | |
|---|---|---|
| EP | 2042825 | 4/2009 |
| GB | 799083 | 7/1958 |

*Primary Examiner* — Joel M Attey

(74) *Attorney, Agent, or Firm* — Fletcher Yoder, P.C.

(57) ABSTRACT

A heat exchanger includes a frame and a plurality of coil passes disposed within the frame. The plurality of coil passes is configured to direct a flow of a refrigerant therethrough to transfer heat with an air flow passing over the heat exchanger. The plurality of coil passes include a U-bend disposed between first and second linear portions of the plurality of coil passes to redirect the refrigerant from a first longitudinal end of the heat exchanger to a second longitudinal end of the heat exchanger. Additionally, a first plurality of fins is disposed on an outer surface the U-bend.

23 Claims, 8 Drawing Sheets

(56) References Cited

U.S. PATENT DOCUMENTS

| | | | | |
|---|---|---|---|---|
| 4,926,931 | A * | 5/1990 | Larinoff | F28B 9/10 165/113 |
| 5,186,248 | A * | 2/1993 | Halstead | F28F 9/18 165/173 |
| 5,207,074 | A * | 5/1993 | Cox | F28B 1/06 62/515 |
| 9,370,815 | B2 | 6/2016 | Jin et al. | |
| 2005/0247077 | A1 | 11/2005 | Hermes et al. | |
| 2007/0187851 | A1 | 8/2007 | Facuis et al. | |
| 2010/0276133 | A1* | 11/2010 | Ojiro | F28D 1/0477 165/181 |
| 2017/0356691 | A1 | 12/2017 | Willis et al. | |
| 2018/0119998 | A1 | 5/2018 | Suzuki et al. | |

* cited by examiner

FINNED HEAT EXCHANGER U-BENDS, MANIFOLDS, AND DISTRIBUTOR TUBES

CROSS REFERENCE TO RELATED APPLICATIONS

This application is a continuation of U.S. patent application Ser. No. 15/614,396, filed Jun. 5, 2017, entitled "FINNED HEAT EXCHANGER U-BENDS, MANIFOLDS, AND DISTRIBUTOR TUBES," which claims priority from and the benefit of U.S. Provisional Patent Application No. 62/421,047, filed Nov. 11, 2016, entitled "FINNED HEAT EXCHANGER U-BENDS, MANIFOLDS, DISTRIBUTOR TUBES," which are hereby incorporated by reference.

BACKGROUND

The present disclosure relates generally to heating, ventilating, and air conditioning systems (HVAC) and, more particularly, to finned coil portions of the HVAC systems.

A wide range of applications exists for HVAC systems. For example, residential, light commercial, commercial, and industrial systems are used to control temperatures and air quality in indoor environments and buildings. Generally, HVAC systems may circulate a fluid, such as a refrigerant, through a closed loop between an evaporator where the fluid absorbs heat and a condenser where the fluid releases heat. The fluid flowing within the closed loop is generally formulated to undergo phase changes within the normal operating temperatures and pressures of the system so that quantities of heat can be exchanged by virtue of the latent heat of vaporization of the fluid.

HVAC units, such as heat exchangers, air handlers, heat pumps, and air conditioning units, are used to provide conditioned air to conditioned environments. Depending on specifications and requirements of the conditioned environment, the HVAC units may require larger equipment or more energy to condition the air for the conditioned environment. However, the increased equipment size or increased energy use may correspond to increased capital and/or operating costs of the HVAC units. Accordingly, it may be desirable to increase the efficiency of certain processes of the HVAC units.

SUMMARY

In one embodiment of the present disclosure, a heat exchanger includes a frame and a plurality of coil passes disposed within the frame. The plurality of coil passes is configured to direct a flow of a refrigerant therethrough to transfer heat with an air flow passing over the heat exchanger. The plurality of coil passes includes a U-bend disposed between first and second linear portions of the plurality of coil passes to redirect the refrigerant from a first longitudinal end of the heat exchanger to a second longitudinal end of the heat exchanger. Additionally, a first plurality of fins is disposed on an outer surface the U-bend.

In another embodiment of the present disclosure, a heat exchanger includes a frame and a plurality of coil passes disposed within the frame. The plurality of coil passes is configured to direct a flow of a refrigerant therethrough to transfer heat with an air flow passing over the heat exchanger. The heat exchanger also includes a distributor fluidly coupled to the plurality of coil passes and configured to supply the flow of the refrigerant to the plurality of coil passes. Additionally, a first plurality of fins is disposed on an outer surface of the distributor.

In a further embodiment of the present disclosure, a heat exchanger includes a frame and a plurality of coil passes disposed within the frame. The plurality of coil passes is configured to direct a flow of a refrigerant therethrough to transfer heat with an air flow passing over the heat exchanger. Additionally, the heat exchanger includes a header manifold configured to receive the flow of the refrigerant from the plurality of coil passes. Moreover, a first plurality of fins is disposed on the header manifold.

Other features and advantages of the present application will be apparent from the following, more detailed description of the embodiments, taken in conjunction with the accompanying drawings, which illustrate, by way of example, the principles of the application.

DRAWINGS

DETAILED DESCRIPTION

The present disclosure is directed to heating, ventilating, and air conditioning (HVAC) systems and components of HVAC systems that include fins (e.g., heat transfer fins) that may increase a heat transfer surface area for an evaporator coil or other heat exchanger of the HVAC systems. In general, HVAC systems may include an indoor heat exchanger to transfer heat from outdoor air and/or return air to a coolant or refrigerant when the HVAC systems are operating in a cooling mode. In general, the coolant may flow through multiple coil passes within the indoor heat exchanger, while the air flows over an outer surface of the multiple coil passes. In this manner, thermal energy leaves the air to warm the coolant. To increase the heat transfer surface area of the multiple coil passes, coil portions such as U-bends, distributor tubes, and header manifolds of the multiple coil passes may include fins or other comparable surface features. The fins may be disposed within a flow path of the air such that more thermal energy may be removed from the air for a given size of the indoor heat exchanger. Thus, smaller, less expensive equipment may be employed for conditioning an indoor environment compared to indoor heat exchangers without finned U-bends, distributor tubes, and header manifolds. Additionally, by increasing the heat transfer surface area of the indoor heat exchanger and thus an efficiency of the HVAC system, less electrical energy may be utilized by the HVAC system.

Figure 1:
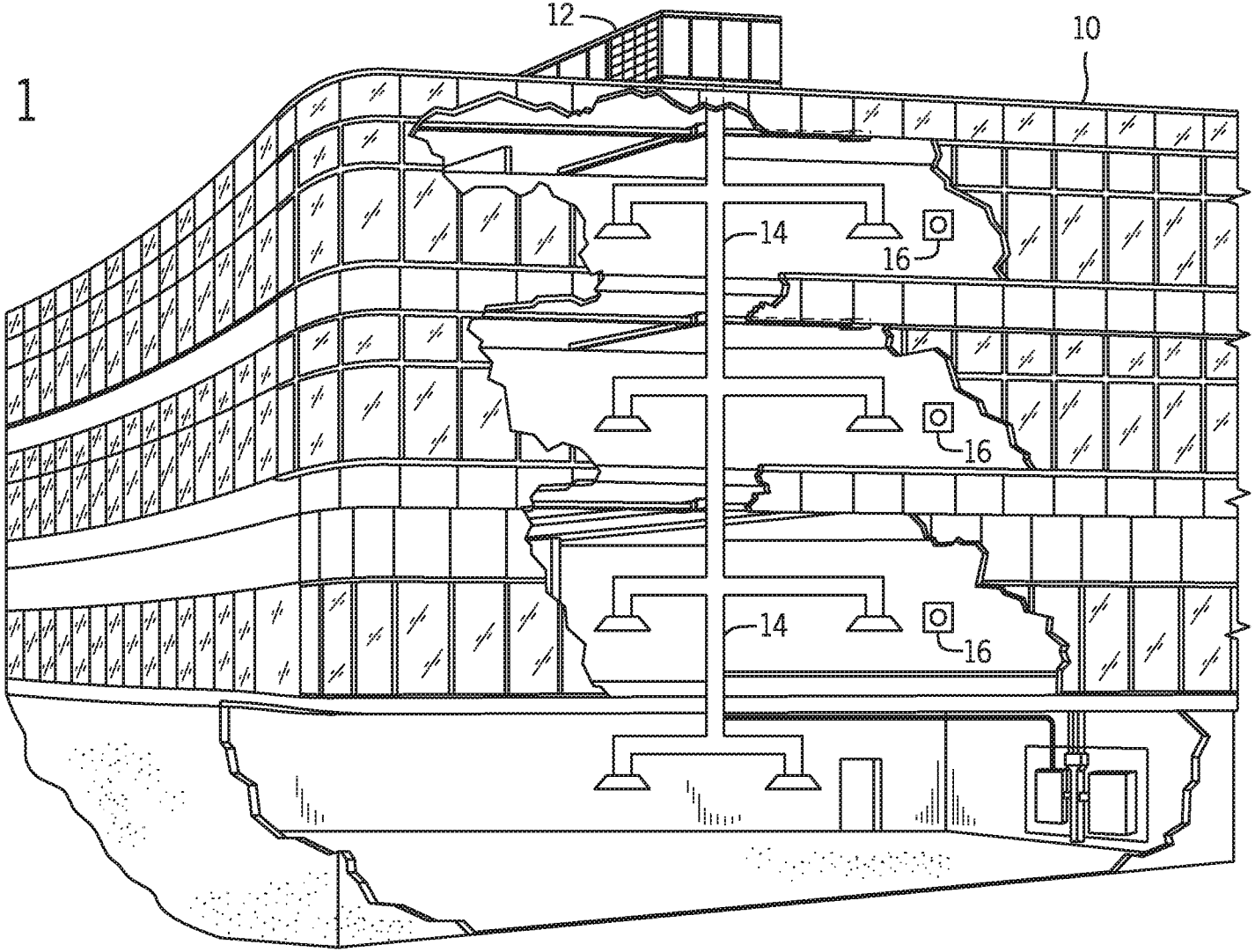
FIG. 1 is a perspective view of a commercial or industrial HVAC system, in accordance with an embodiment of the present techniques.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
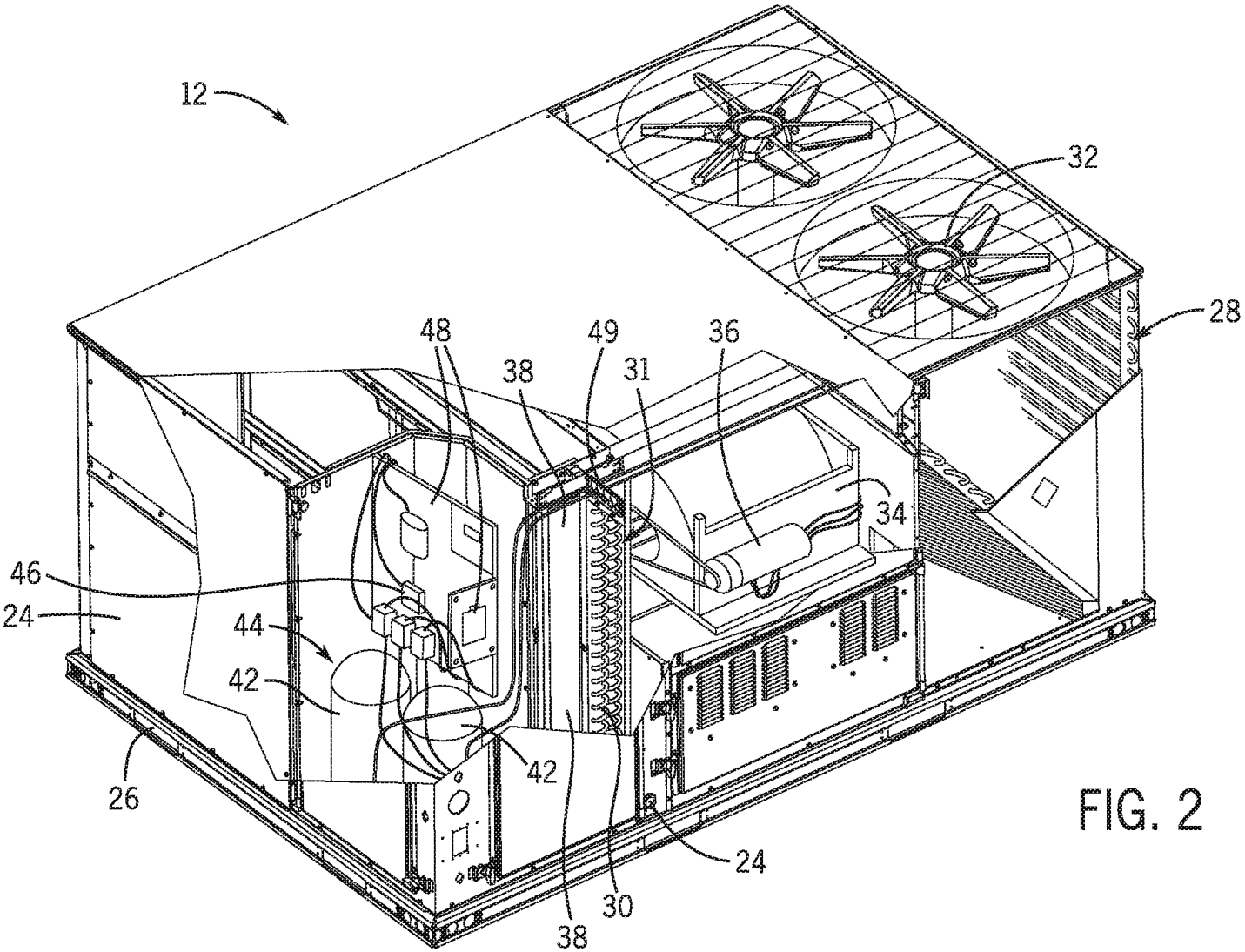
FIG. 2 is an illustration of an embodiment of a packaged unit of the HVAC system shown in FIG. 1, in accordance with an embodiment of the present techniques.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
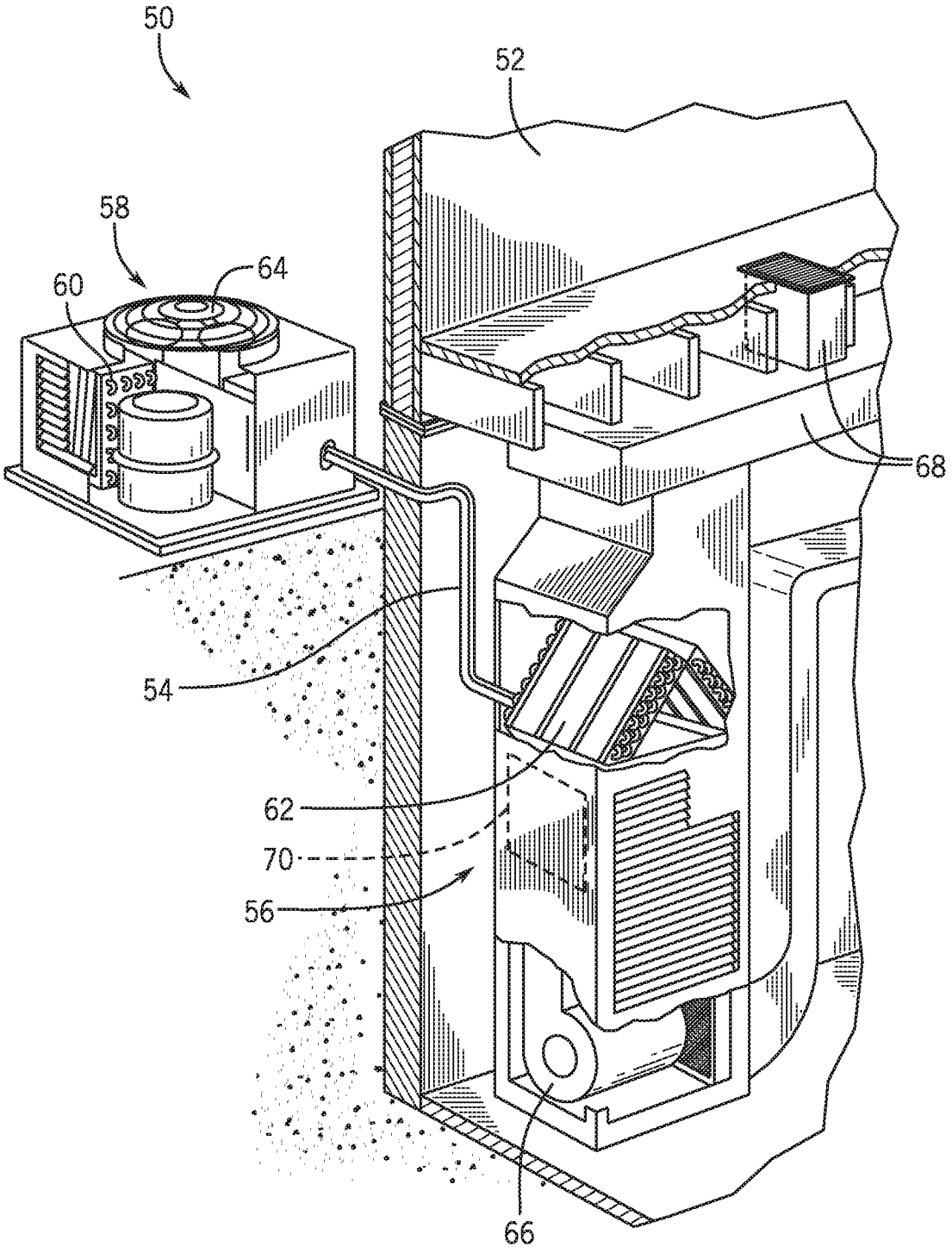
FIG. 3 is an illustration of an embodiment of a split system of the HVAC system shown in FIG. 1, in accordance with an embodiment of the present techniques.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
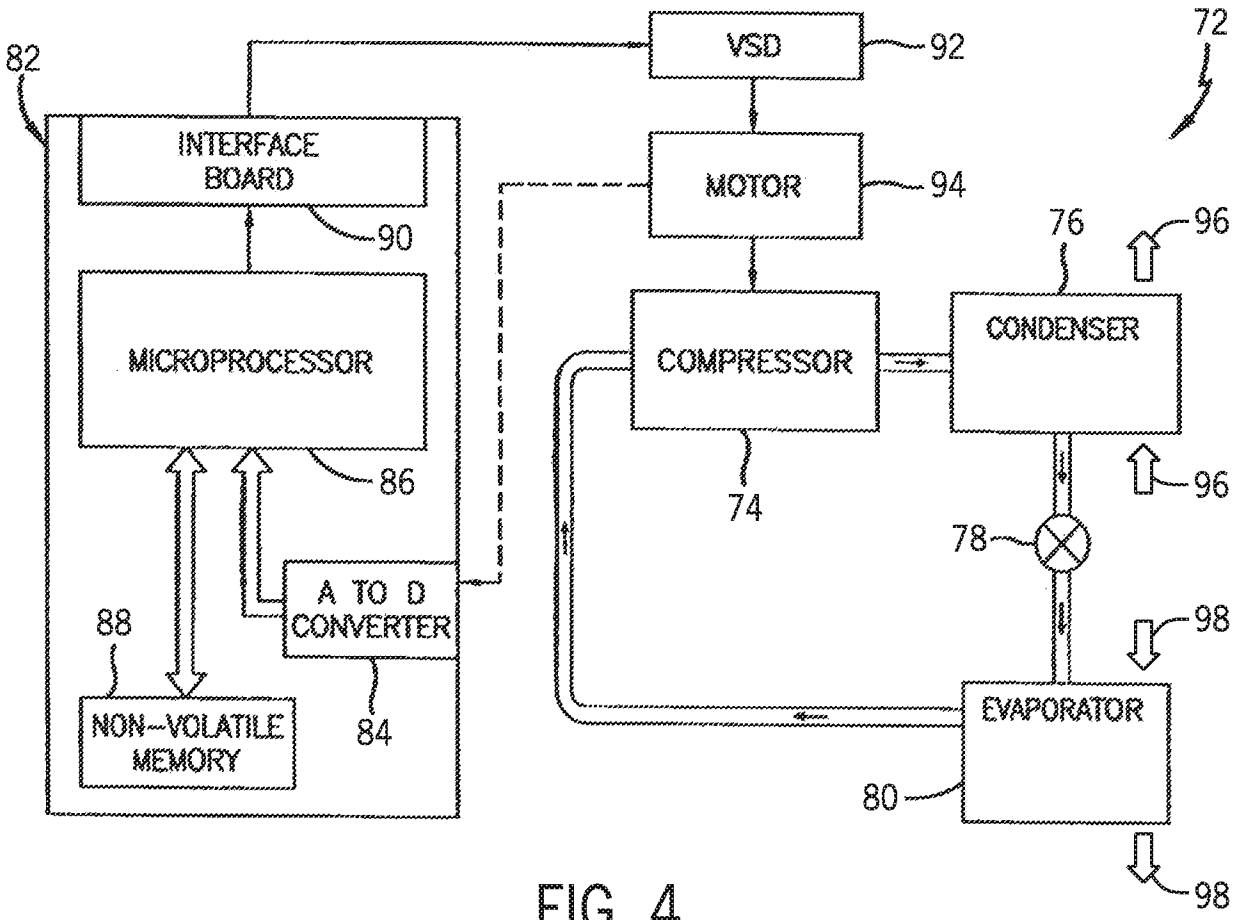
FIG. 4 is a schematic diagram of an embodiment of a refrigeration system of the HVAC system shown in FIG. 1, in accordance with an embodiment of the present techniques.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed in more detail below, certain coil portions of the HVAC unit 12, the residential heating and cooling system 50, or other HVAC systems may include fins (e.g., heat transfer fins) to increase a surface area for heat transfer. For example, the heat exchanger 62 may include fins on U-bends, distributor tubes, and/or header manifolds of to increase a heat transfer surface area of the heat exchanger 62 and thus increase an efficiency of the residential heating and cooling system 50. Moreover, it is to be understood that these techniques may be applied to other elements of any suitable HVAC and/or refrigeration system.

Figure 5:
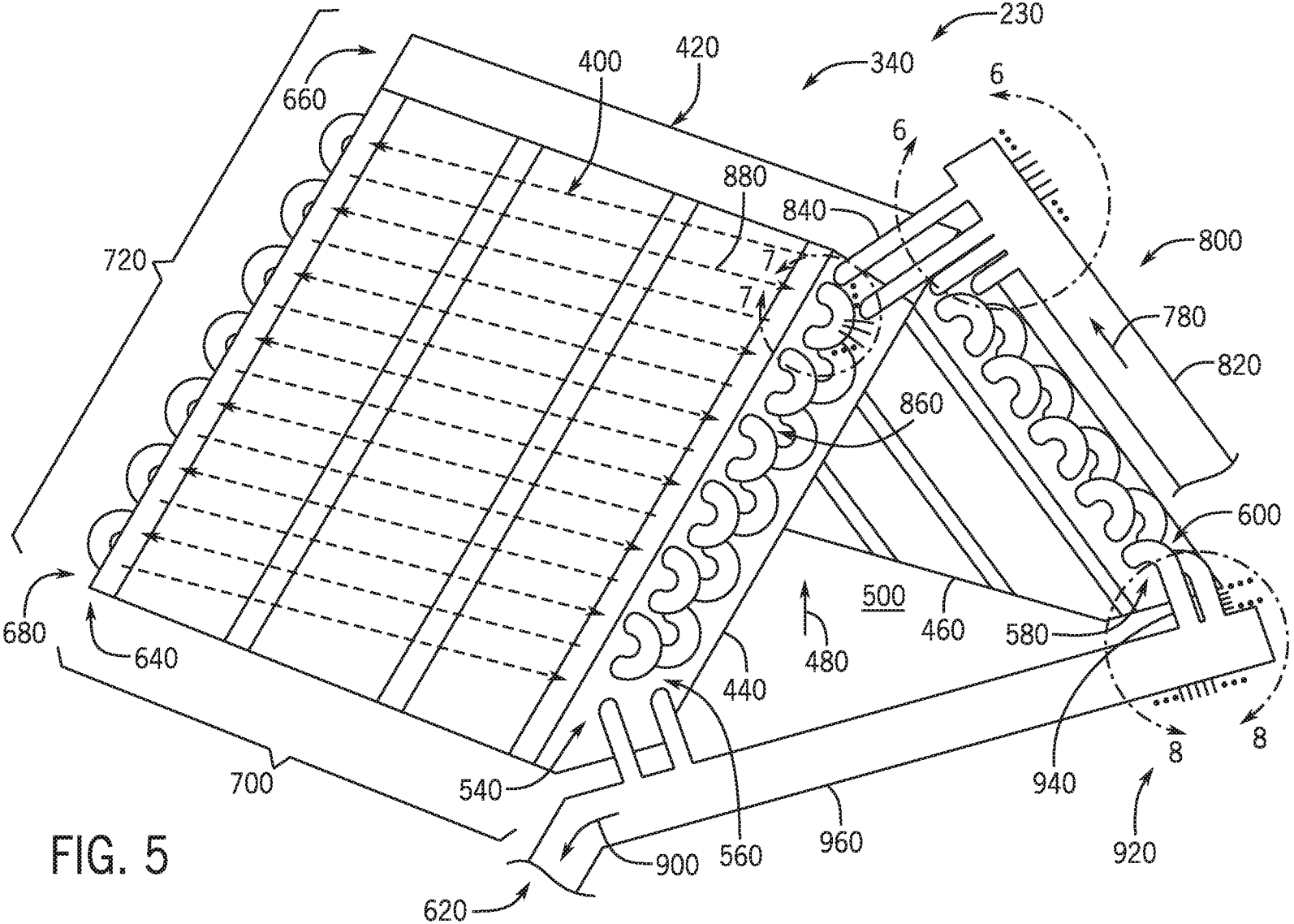
FIG. 5 is a perspective view of a heat exchanger of the split system shown in FIG. 3, in accordance with an embodiment of the present techniques.

FIG. 5 is a perspective view of a heat exchanger 340, including finned coil portions to increase and improve a heat transfer surface area of the heat exchanger 340. In some embodiments, the heat exchanger 340 corresponds with the heat exchanger 62 of FIG. 3. The heat exchanger 340 is a part of a heating and cooling system 230, which may be any of the systems discussed above. As shown, the heat exchanger 340 includes multiple coil passes 400 disposed within a frame 420. The frame 420 is an A-shaped frame, but other suitably shaped frames, such as M-shaped frames, N-shaped frames, among others, may be employed by the techniques disclosed herein. In some embodiments, the frame 420 includes sheets or fins that hold the multiple coil passes 400 in an operating position. The frame 420 includes a first frame portion 440 coupled to a second frame portion 460. The first and second frame portions 440, 460 may be angled relative to one another, such that an air flow 480 may be drawn through an open space 500 within the first and second frame portions 440, 460 and across the multiple coil passes 400. The air flow 480 may be drawn or pushed along one or more corresponding air flow paths. In other embodiments, the heat exchanger 340 may be oriented another direction, such that down flow or side flow configurations, instead of the depicted up flow configuration, are achieved as desired.

The heat exchanger 340 may include multiple parallel circuits. For example, the heat exchanger 340 includes two parallel circuits on each frame portion 440, 460. That is, a first parallel circuit 540 may be defined in an outer surface of the first frame portion 440, a second parallel circuit 560 may be defined in an inner surface of the first frame portion 440, a third parallel circuit 580 may be defined in an inner surface of the second frame portion 460, and a fourth parallel circuit 600 may be defined in an outer surface of the second frame portion 460. Each parallel circuit 540, 560, 580, 600 may wind back and forth within the heat exchanger 340. For example, the parallel circuits 540, 560, 580, 600 may include the multiple coil passes 400 that extend from a first longitudinal end 620 of the heat exchanger 340 to a second longitudinal end 640 of the heat exchanger 340 and from an upper end 660 of the heat exchanger 340 to a lower end 680 of the heat exchanger 340. By winding through an entire length 700 and height 720 of the heat exchanger 340, the parallel circuits 540, 560, 580, 600 provide heat transfer surface area for cooling or heating of the air flow 480 across the heat exchanger 340.

To provide refrigerant 780 to the multiple coil passes 400, the heat exchanger 340 includes a distributor 800. The distributor 800 may supply the refrigerant 780 from a main distributor tube 820 to distributor tubes 840 individually connected to each parallel circuit 540, 560, 580, 600 of the heat exchanger 340. Thus, the refrigerant 780 flows through each parallel circuit 540, 560, 580, 600. When the heating and cooling system 230 is operating as an air conditioner, the refrigerant 780 is supplied at a low temperature, such that thermal energy from the air flow 480 may transfer to the refrigerant 780. The refrigerant 780 may also be supplied at sufficient pressure to ensure a flow of the refrigerant 780 through the multiple coil passes 400 travels completely therethrough. Additionally, as discussed below with reference to FIG. 6, the distributor 800 may include fins within an air flow path of the air flow 480 to increase the heat transfer surface area of the heat exchanger 340.

To return the refrigerant 780 from the first longitudinal end 620 to the second longitudinal end 640 of the multiple coil passes 400 and back again, each parallel circuit 540, 560, 580, 600 may include multiple U-bends 860. The U-bends 860 may be disposed between linear portions 880 of the multiple coil passes 400. Refrigerant 780 may therefore flow from the distributor 800, through one linear portion 880 of the multiple coil passes 400, through one U-bend 860, and through another linear portion 880 of the multiple coil passes 400. Therefore, the refrigerant 780 is continuously provided through the heat exchanger 340 for transferring heat with the air flow 480. Additionally, as discussed below with reference to FIG. 7, the U-bends 860 may include fins within an air flow path of the air flow 480 to increase the heat transfer surface area of the heat exchanger 340.

After the refrigerant 780 has traveled through the multiple coil passes 400, spent refrigerant 900 is continuously removed from the multiple coil passes 400 via a header manifold 920. The spent refrigerant 900 from each parallel circuit 540, 560, 580, 600 may flow into a respective header manifold tube 940 and to a main header manifold tube 960 of the header manifold 920. Each header manifold tube 940 is fluidly connected to the main header manifold tube 960, which receives the spent refrigerant 900 and directs the spent refrigerant 900 to the next portion of the refrigeration cycle, where the spent refrigerant 900 is recharged. Moreover, as discussed below with reference to FIG. 8, the header manifold 920 may include fins within an air flow path of the air flow 480 to increase the heat transfer surface area of the heat exchanger 340. That is, although some of a cooling or heating load of the spent refrigerant 900 may have been transferred to the air flow 480, the addition of fins on the header manifold 920 may provide further cooling or heating loads to the air flow 480.

Figure 6:
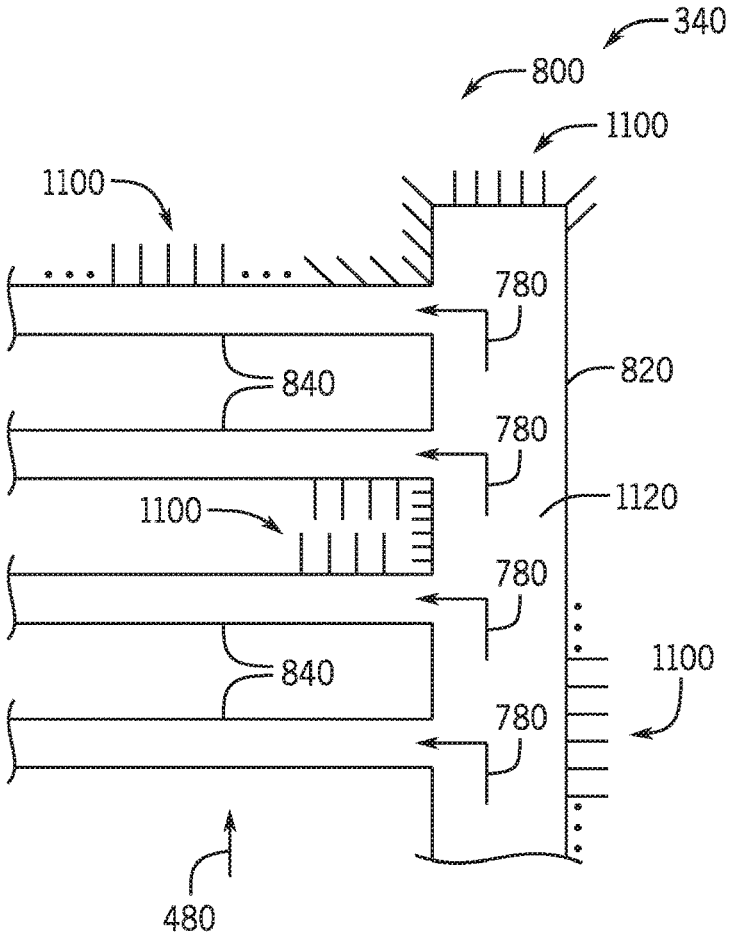
FIG. 6 is a schematic diagram of a U-bend of the HVAC system, taken along the 6-6 line in FIG. 5, in accordance with an embodiment of the present techniques.

FIG. 6 is a schematic view of the distributor 800, taken along line 6-6 of FIG. 5. The distributor 800 supplies refrigerant 780 though the main distributor tube 820 and into each distributor tube 840. Then, the refrigerant 780 passes through the multiple coil passes 400 of the heat exchanger 340.

As shown, the distributor 800 includes fins 1100 coupled to an outer surface 1120 of the distributor 800. The fins 1100 may be coupled to the main distributor tube 820 and each distributor tube 840. In certain embodiments, the fins 1100 may only be coupled to a portion of the main distributor tube 820 and a portion of each distributor tube 840. In some embodiments, a longitudinal axis of the fins 1100 may be generally perpendicular to the outer surface 1120 of the distributor 800. Additionally, to provide fins 1100 in junctions between each distributor tube 840 and the main distributor tube 820, the longitudinal axis of the fins 1100 may be disposed at 45 degrees or another suitable angle less than 90 degrees from the outer surface 1120 of the distributor 800. Additionally, the fins 1100 on the main distributor tube 820 and the distributor tubes 840 may have different lengths or heights, such that more fins 1100 may be supplied on the outer surface 1120 of the distributor 800. The fins 1100 may be slit-type fins, spiny-type fins, ribbon-type fins, or another suitable type of fin, as discussed below with reference to FIGS. 9 and 10. By including the fins 1100 on the distributor 800 and disposing the fins 1100 within an air flow path of the air flow 480, the heat exchanger 340 includes a greater heat transfer surface area for providing conditioned air compared to a heat exchanger without a finned distributor.

Figure 7:
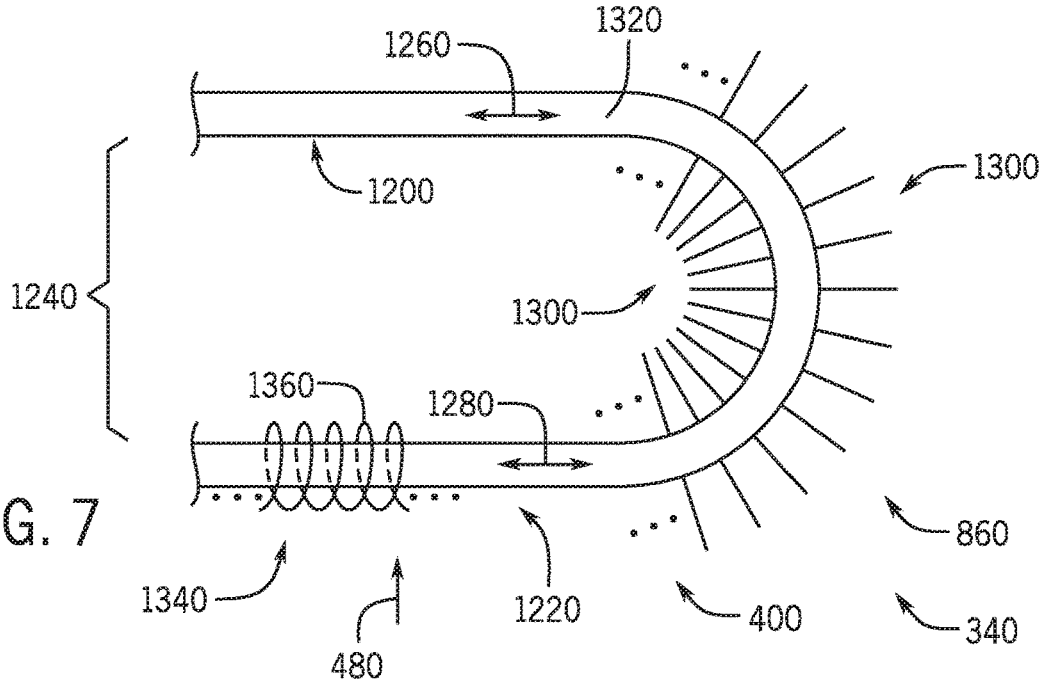
FIG. 7 is a schematic diagram of a distributor tube of the HVAC system, taken along the 7-7 line in FIG. 5, in accordance with an embodiment of the present techniques.

FIG. 7 is a schematic view of the U-bend 860, taken along line 7-7 of FIG. 5. The U-bend 860 is disposed between a first linear portion 1200 and a second linear portion 1220 of the multiple coil passes 400. The U-bend 860 may be formed by bending one straight portion of the multiple coil passes 400 such that the first and second linear portions 1200 and 1220 are separated by a width 1240. Accordingly, a first longitudinal axis 1260 of the first linear portion 1200 and a second longitudinal axis 1280 of the second linear portion 1220 may be approximately parallel to one another. It is to be understood that approximately parallel means the first longitudinal axis 1260 and the second longitudinal axis 1280 extend in the same direction within 1, 2, 3, 4, 5, 6, 7, 8, 9, or 10 degrees. The refrigerant 780 may flow through the first linear portion 1200, through the U-bend 860, and subsequently through the second linear portion 1220.

As shown, the U-bend 860 includes fins 1300 coupled to an outer surface 1320 of the U-bend 860. The fins 1300 may be coupled to the U-bend 860, the first linear portion 1200, and the second linear portion 1220. In certain embodiments, the fins 1300 may only be coupled to a portion of the U-bend 860 and/or a portion of the first linear portion 1200 and/or a portion of the second linear portion 1220. In some embodiments, a longitudinal axis of the fins 1300 may be generally perpendicular to the outer surface 1320 of the U-bend 860. Additionally, to provide the fins 1300 along the curved outer surface 1320, the longitudinal axis of the fins 1300 may be disposed at 45 degrees or another suitable angle less than 90 degrees from the outer surface 1320 of the U-bend 86. In some embodiments, a width between the first linear portion 1200 and the second linear portion 1220 is at least twice as wide as a height of the fins 1300, so that the fins 1300 may be disposed on the first and second linear portions 1200, 1220 without overlapping. The fins 1300 may be slit-type fins, spiny-type fins, or another suitable type of fin, as discussed below with reference to FIGS. 9 and 10. For example, ribbon-type fins 1340 may be disposed around at least a portion of the U-bend 860. As shown, the ribbon-type fins may be a strip of metal 1360 that is adhered in a swirling manner on the outer surface 1320 of the U-bend 860. By including the fins 1300 on the U-bend 860 and disposing the fins 1300 within an air flow path of the air flow 480, the heat exchanger 340 includes a greater heat transfer surface area for providing conditioned air compared to a heat exchanger without finned U-bends.

Figure 8:
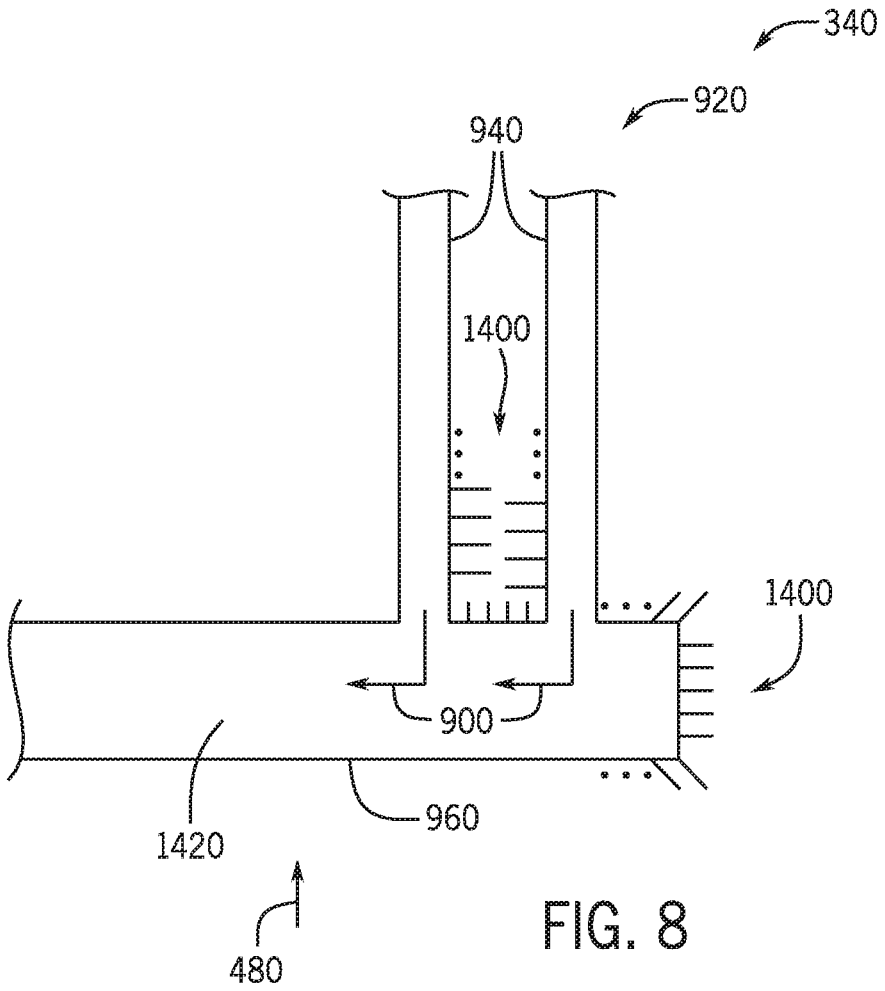
FIG. 8 is a schematic diagram of a header manifold of the HVAC system, taken along the 8-8 line in FIG. 5, in accordance with an embodiment of the present techniques.

FIG. 8 is a schematic view of the header manifold 920, taken along line 8-8 of FIG. 5. The header manifold 920 receives the spent refrigerant 900 though the header manifold tubes 940 and directs the spent refrigerant 900 through the main header manifold tube 960. The spent refrigerant 900 is therefore continuously collected from the heat exchanger 340 for regeneration in other components of the heating and cooling system 230.

As shown, the header manifold 920 includes fins 1400 coupled to an outer surface 1420 of the header manifold 920. The fins 1400 may be coupled to each header manifold tube 940 and the main header manifold tube 960. In certain embodiments, the fins 1400 may only be coupled to a portion of each header manifold tube 940 and/or a portion of the main header manifold tube 960. In some embodiments, a longitudinal axis of the fins 1400 may be generally perpendicular to the outer surface 1420 of the header manifold 920. Additionally, to provide the fins 1400 in junctions between each header manifold tube 940 and the main header manifold tube 960, the longitudinal axis of the fins 1400 may be disposed at 45 degrees or another suitable angle less than 90 degrees from the outer surface 1420 of the header manifold 920. Additionally, the fins 1400 on each header manifold tube 940 and the main header manifold tube 960 may have different lengths or heights, such that more fins 1400 may be supplied on the outer surface 1420 of the header manifold 920. The fins 1400 may be slit-type fins, spiny-type fins, ribbon-type fins, or another suitable type of fin, as discussed below with reference to FIGS. 9 and 10. By including the fins 1400 on the header manifold 920 and disposing the fins 1400 within an air flow path of the air flow 480, the heat exchanger 340 includes a greater heat transfer surface area for providing conditioned air compared to a heat exchanger without a finned distributor.

Figure 9:
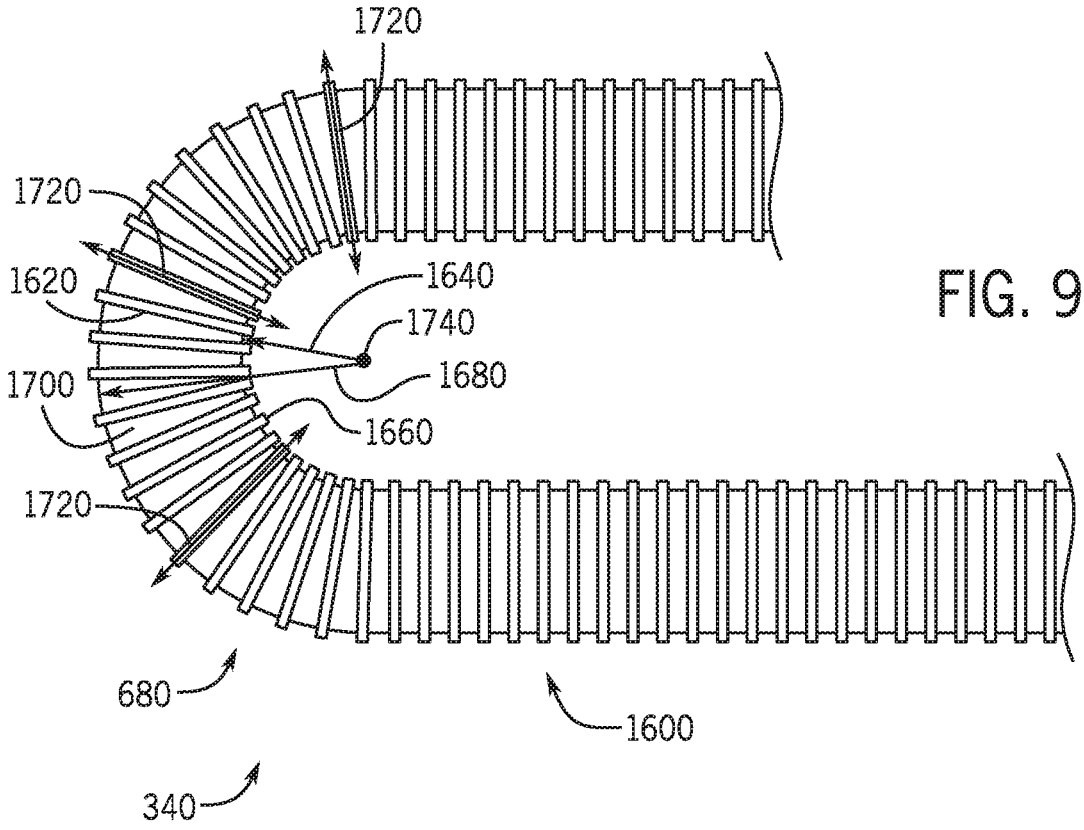
FIG. 9 is a perspective view of slit fins on a U-bend, in accordance with an embodiment of the present techniques.

FIG. 9 is a perspective view of a finned coil portion having slit fins 1600. As discussed above, the slit fins 1600 may be included on any suitable finned coil portion, including the U-bends 860, the distributor 800, and/or the header manifold 920 of the heat exchanger 340. As shown, the slit fins 1600 are attached to a tubular surface 1620. The tubular surface 1620 may correspond with any of the outer surfaces 1120, 1320, 1420 discussed above. For example, the tubular surface 1620 may be the outer surface 1320 of the U-bend 860. As such, the tubular surface 1620 may include an inner radius of curvature 1640 defined from an inner portion 1660 of the tubular surface 1620 to a central intersection point 1740 that is smaller than an outer radius 1680 of curvature defined from an outer portion 1700 of the tubular surface 1620 to the central intersection point 1740.

To provide the slit fins 1600 around the tubular surface 1620, the slit fins 1600 may be spaced closer together on the inner portion 1660 of the tubular surface 1620 than on the outer portion 1700 of the tubular surface 1620. That is, a longitudinal axis 1720 through each slit fin 1600 on the U-bend 860 may extend approximately through the central intersection point 1740. It is to be understood that approximately extending through the central intersection point 1740 means the longitudinal axis 1720 extends through the central intersection point 1740 within 1, 2, 3, 4, 5, 6, 7, 8, 9, or 10 percent of the distance between a respective slit fin 1600 and the central intersection point 1740. Additionally, the slit fins 1600 may be welded on the tubular surface 1620, injection molded on the tubular surface 1620, or integrally formed with the tubular surface 1620. The slit fins 1600 may be provided on linear portions of the multiple coil passes 400, the distributor 800, and/or the header manifold 920 as desired. Thus, the heat transfer surface area of the heat exchanger 340 is greater than that of a heat exchanger without finned coil portions.

Figure 10:
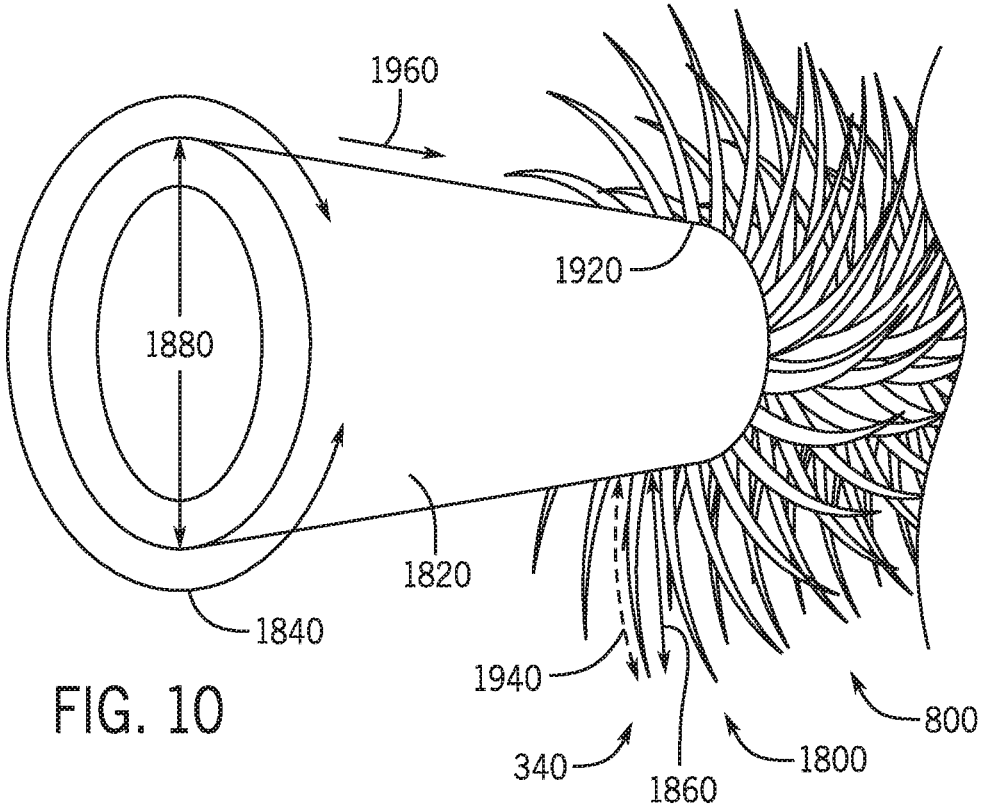
FIG. 10 is a perspective view of spiny fins on a coil portion, in accordance with an embodiment of the present techniques.

FIG. 10 is a perspective view of a finned coil portion having spiny fins 1800. As discussed above, the spiny fins 1800 may be included on any suitable finned coil portion, including the U-bends 860, the distributor 800, and/or the header manifold 920 of the heat exchanger 340. As shown, the spiny fins 1800 are attached to a tubular surface 1820. The tubular surface 1820 may correspond with any of the outer surfaces 1120, 1320, 1420 discussed above. For example, the tubular surface 1820 may be the outer surface 1120 of the distributor 800. As shown, multiple spiny fins 1800 are disposed around a circumference 1840 of the tubular surface 1820. For example, there may be 10 spiny fins, 20 spiny fins, 40 spiny fins, 100 spiny fins, or more disposed around the tubular surface 1820. The spiny fins 1800 may have a height 1860 that is equal or nearly equal to an outer diameter 1880 of the finned coil portion. Moreover, the spiny fins 1800 may have a circumferential tilt or swirl, such that a tip 1900 of each spiny fin 1800 is not disposed directly above a base 1920 of each spiny fin 1800 in a circumferential direction. As such, the spiny fins 1800 may each be tapered along a length 1940 of the spiny fin 1800 between the tip 1900 and the base 1920 of each spiny fin 1800. Instead, each spiny fin 1800 may be leaning or folding to the left or to the right when viewed along a longitudinal direction 1960 of the tubular surface 1820. Adjacent rows of the spiny fins 1800 may lean or curve in the same direction or in the opposite direction.

To provide the spiny fins 1800 around the tubular surface 1820, the spiny fins 1800 may be welded on the tubular surface 1820 or integrally formed with the tubular surface 1820. The spiny fins 1800 may be provided on linear portions and/or curved portions of the multiple coil passes 400, the distributor 800, and/or the header manifold 920 as desired. Thus, the heat transfer surface area of the heat exchanger 340 is greater than that of a heat exchanger without finned coil portions.

Accordingly, the present disclosure is directed to providing heat transfer fins on coil portions of a heat exchanger 340 and disposing the finned portions within the air flow 480 passing across the heat exchanger 340 to increase the surface area for heat transfer. The additional heat transfer surface area provides for conditioned air more efficiently than heat exchangers without finned coil portions. Thus, capital and maintenance costs for providing the desired conditioned air to the indoor space are reduced.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the embodiments, all features of an actual implementation may not have been described (i.e., those unrelated to the presently contemplated best mode of carrying out the disclosure, or those unrelated to enabling the claimed features). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchanger of a heating, ventilation, and air conditioning (HVAC) system, comprising:

a frame configured to be disposed within an air handling enclosure of the HVAC system, wherein the frame comprises a plurality of sheets;

a plurality of coil passes retained by the plurality of sheets, wherein the plurality of coil passes is configured to direct a refrigerant flow therethrough to transfer heat with an air flow passing through the air handling enclosure, and wherein the plurality of coil passes comprises:

a first linear portion and a second linear portion;

a U-bend fluidly coupling the first linear portion and the second linear portion; and a first portion of a plurality of fins disposed on a first outer surface of the U-bend; and a plurality of distributor tubes fluidly coupled to the plurality of coil passes, wherein a second portion of the plurality of fins is disposed on a second outer surface of a distributor tube of the plurality of distributor tubes.

2. The heat exchanger of claim 1, wherein the plurality of fins comprises a plurality of ribbon-type fins, and wherein the plurality of ribbon-type fins comprises a metallic strip that extends helically around the first outer surface of the U-bend.

3. The heat exchanger of claim 1, wherein the plurality of fins is disposed within an air flow path of the air flow passing through the air handling enclosure.

4. The heat exchanger of claim 1, wherein the first portion of the plurality of fins is injection molded or integrally formed with the U-bend.

5. The heat exchanger of claim 1, wherein the frame comprises an A-shape, an M-shape, or an N-shape.

6. The heat exchanger of claim 1, wherein the plurality of sheets extends in a first direction, wherein the first linear portion and the second linear portion each extend in a second direction through corresponding openings of the plurality of sheets, and wherein the first direction is crosswise to the second direction.

7. The heat exchanger of claim 6, wherein a distance between the first linear portion and the second linear portion is defined along the first direction and is at least twice a longitudinal dimension of the first portion of the plurality of fins.

8. The heat exchanger of claim 1, comprising a header manifold fluidly coupled to the plurality of coil passes, wherein the header manifold is configured to receive the refrigerant flow from the plurality of coil passes, and wherein a plurality of ribbon-type fins is disposed on an additional outer surface of the header manifold.

9. The heat exchanger of claim 1, comprising a distributor, wherein the distributor comprises a main distributor tube fluidly coupled to the plurality of distributor tubes, wherein the distributor is configured to provide the refrigerant flow to the plurality of coil passes, and wherein a plurality of additional fins is disposed on an additional outer surface of the main distributor tube.

10. The heat exchanger of claim 9, wherein the plurality of additional fins comprises a plurality of ribbon-type fins.

11. A heat exchanger of a heating, ventilation, and air conditioning (HVAC) system, comprising:

a frame configured to be disposed within an air handling enclosure of the HVAC system, wherein the frame comprises a plurality of sheets;

a plurality of coil passes retained within the frame by the plurality of sheets, wherein the plurality of coil passes is configured to direct a refrigerant flow therethrough to transfer heat with an air flow passing through the air handling enclosure;

a distributor fluidly coupled to the plurality of coil passes, wherein the distributor is configured to provide the refrigerant flow to the plurality of coil passes, and wherein a first plurality of fins is disposed on a first outer surface of the distributor; and a plurality of header manifold tubes fluidly coupled to the plurality of coil passes, wherein the plurality of header manifold tubes is configured to receive the refrigerant flow from the plurality of coil passes, and wherein a second plurality of fins is disposed on a second outer surface of a header manifold tube of the plurality of header manifold tubes.

12. The heat exchanger of claim 11, wherein the first plurality of fins and the second plurality of fins are disposed within an air flow path of the air flow passing through the air handling enclosure, and wherein the first plurality of fins and the second plurality of fins each comprise a respective plurality of ribbon-type fins.

13. The heat exchanger of claim 11, wherein the distributor comprises:

a main distributor tube; and a plurality of distributor tubes fluidly coupled between the main distributor tube and the plurality of coil passes, wherein each distributor tube of the plurality of distributor tubes is configured to receive a respective portion of the refrigerant flow from the main distributor tube and direct the respective portion to a corresponding parallel circuit of the plurality of coil passes.

14. The heat exchanger of claim 13, wherein a first portion of the first plurality of fins is disposed on the main distributor tube, wherein a second portion of the first plurality of fins is disposed on the plurality of distributor tubes, and wherein the first portion of the first plurality of fins has a first longitudinal dimension that is less than a second longitudinal dimension of the second portion of the first plurality of fins.

15. The heat exchanger of claim 11, wherein:

the plurality of header manifold tubes is fluidly coupled between the plurality of coil passes and a main header manifold tube, wherein each header manifold tube of the plurality of header manifold tubes is configured to receive a respective portion of the refrigerant flow from a corresponding parallel circuit of the plurality of coil passes and direct the respective portion to the main header manifold tube.

16. The heat exchanger of claim 15, wherein the second plurality of fins comprises a first plurality of ribbon-type fins, and wherein a second plurality of ribbon-type fins is disposed on the main header manifold tube.

17. The heat exchanger of claim 11, wherein the plurality of coil passes comprises a first linear portion, a second linear portion, a U-bend fluidly coupling the first linear portion and the second linear portion, and a third plurality of fins disposed on a third outer surface of the U-bend.

18. A heating, ventilation, and air condition (HVAC) system, comprising:

an air handling enclosure;

a heat exchanger frame disposed within the air handling enclosure, wherein the heat exchanger frame comprises a plurality of sheets;

a plurality of heat exchanger coils retained within the heat exchanger frame by the plurality of sheets, wherein, during operation of the HVAC system, the plurality of heat exchanger coils directs a refrigerant flow therethrough to transfer heat with an air flow passing through the air handling enclosure, and wherein the plurality of heat exchanger coils comprises:

a first linear portion and a second linear portion;

a U-bend fluidly coupling the first linear portion and the second linear portion; and a first plurality of ribbon-type fins disposed on a first outer surface of the U-bend;

a plurality of header manifold tubes fluidly coupled to the plurality of heat exchanger coils, wherein the plurality of header manifold tubes is configured to receive the refrigerant flow from the plurality of heat exchanger coils, and wherein a second plurality of ribbon-type fins is disposed on respective second outer surfaces of the plurality of header manifold tubes; and a plurality of distributor tubes fluidly coupled to the plurality of heat exchanger coils, wherein a third plurality of ribbon-type fins is disposed on respective third outer surfaces of the plurality of distributor tubes.

19. The HVAC system of claim 18, comprising a supply fan configured to direct the air flow along an air flow path through the air handling enclosure during operation of the HVAC system, wherein the first plurality of ribbon-type fins, the second plurality of ribbon-type fins, and the third plurality of ribbon-type fins are disposed within the air flow path.

20. The HVAC system of claim 18, wherein the first plurality of ribbon-type fins is formed by a continuous strip that extends in a spiral around the first outer surface of the U-bend.

21. The HVAC system of claim 20, wherein the continuous strip is attached to the first outer surface of the U-bend.

22. The HVAC system of claim 18, comprising:

a main distributor tube fluidly coupled to the plurality of heat exchanger coils and to the plurality of distributor tubes, wherein the main distributor tube is configured to provide the refrigerant flow to the plurality of distributor tubes, wherein a first additional plurality of fins is disposed on a fourth outer surface of the main distributor tube; and a main header manifold tube fluidly coupled to the plurality of heat exchanger coils and to the plurality of header manifold tubes, wherein the main header manifold tube is configured to receive the refrigerant flow from plurality of header manifold tubes, wherein a second additional plurality of fins is disposed on a fifth outer surface of the main header manifold tube.

23. The HVAC system of claim 22, wherein the first additional plurality of fins comprises a fourth plurality of ribbon-type fins, and wherein the second additional plurality of fins comprises a fifth plurality of ribbon-type fins.

* * * * *